US006837138B2

(12) United States Patent
Mang

(10) Patent No.: US 6,837,138 B2
(45) Date of Patent: Jan. 4, 2005

(54) SAW CHAIN

(75) Inventor: Harald Mang, Winnenden (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 10 days.

(21) Appl. No.: 10/376,337

(22) Filed: Mar. 3, 2003

(65) Prior Publication Data

US 2003/0167895 A1 Sep. 11, 2003

(30) Foreign Application Priority Data

Mar. 5, 2002 (DE) ..... 102 09 680

(51) Int. Cl.[7] ..... B27B 33/14
(52) U.S. Cl. ..... 83/830; 83/834; 30/381
(58) Field of Search ..... 83/834, 833, 832, 83/831, 830, 676; 30/381, 388, 505

(56) References Cited

U.S. PATENT DOCUMENTS 2,705,512 A * 4/1955 Wolf ..... 83/834
3,283,789 A * 11/1966 Silvon ..... 30/384
4,581,968 A * 4/1986 Gibson et al. ..... 83/833
4,979,416 A 12/1990 Nitschmann
5,029,501 A * 7/1991 Smith ..... 83/13
5,042,350 A * 8/1991 Nitschmann ..... 83/522.11
6,006,629 A * 12/1999 Lofgren ..... 76/80.5
6,446,534 B1 * 9/2002 Harfst ..... 83/834

FOREIGN PATENT DOCUMENTS

DE 3342323 C1 * 5/1985 ..... B27B/17/02

* cited by examiner

*Primary Examiner*—Kenneth E. Peterson
*Assistant Examiner*—Omar Flores Sánchez
(74) *Attorney, Agent, or Firm*—Walter Ottesen

(57) ABSTRACT

A saw chain for a motor-driven chain saw (1) is formed from center drive links (10) and lateral connecting links (11). A first radius (18) is the maximum distance of the axis (22) of the leading rivet opening (12) to the region (19) facing toward the forward running surface and lying in the running direction. A second radius (20) defines the maximum distance from the axis (23) of the trailing rivet opening (13) of the connecting link (11), which is next adjacent in the running direction (8), to the region (21) of the connecting link (11). The region (21) lies facing toward the rearward running surface (17) opposite to the running direction (8). The second radius (20) is greater than the first radius (18) and the sum of first radius (18) and second radius (20) corresponds approximately to the distance (b) of the axes (26, 27) of the rivet openings (24, 25) of a drive link (10) arranged between the connecting links (11).

13 Claims, 4 Drawing Sheets

8

SAW CHAIN

FIELD OF THE INVENTION

The invention relates to a saw chain for a motor-driven work apparatus including a motor-driven chain saw and a harvester used in the lumber industry for harvesting trees.

BACKGROUND OF THE INVENTION

U.S. Pat. No. 4,979,416 discloses a cutting link for a saw chain of a motor-driven chain saw which has forward and rearward running surfaces. In order to achieve a uniform cutting performance, the suggestion is made to form the rearward running surface of the cutting link larger than the forward running surface. The rearward running surface should be so dimensioned that the removal of material caused by wear is approximately the same at the elevation of the two running surfaces. The movability of the chain is considerably limited because of the lengthening of the rearward running surface. A saw chain of this kind is not suitable for use in guide bars having a small change-of-direction radius.

Saw chains having symmetrically configured forward and rearward surfaces have a short service life under heavy loads because the saw chain tears in the region of the trailing rivet opening. It has been shown that friction martensite forms under heavy loads at the rearward tooth foot which causes an embrittlement of the material. Because of the material embrittlement, tears result which extend up to the trailing rivet opening and lead to a break in the chain. Likewise, the greater load on the rearward running surface leads to an intense removal of material. This leads to a reduction of the wall thickness in the region of the trailing rivet opening and consequently to a break of the chain.

SUMMARY OF THE INVENTION

It is an object of the invention to provide a saw chain for motor-driven chain saws, including for harvesters, which has a long service life and sufficient chain movability.

The saw chain of the invention is for a motor-driven work apparatus including a chain saw and a harvester. The saw chain defines a longitudinal direction and a running direction and the saw chain includes: a plurality of side connecting links and a plurality of center drive links arranged between the side connecting links; each of the links having a flat base body and a leading rivet opening and a trailing rivet opening and each rivet opening defining an axis; the respective axes of the leading and trailing rivet openings of each drive link being at a spacing (b) from each other; a plurality of rivets extending through the rivet openings for pivotally interconnecting the links; a portion of the connecting links being configured as cutting links; each of the cutting links having a cutting tooth formed on the base body thereof on a first end of the cutting link with the cutting tooth extending in the longitudinal direction of the saw chain; each of the cutting links having forward and rearward running surfaces on a second end thereof lying opposite the first side; the forward running surface being approximately at the elevation of the leading rivet opening and the rearward running surface being approximately at the elevation of the trailing rivet opening; the rearward running surface being configured to be extended in a direction opposite to the running direction; each of the connecting links having a first radius defining the maximum distance from the axis of the leading rivet opening thereof to the forward region of the connecting link, which forward region faces toward the forward running surface, and which forward region lies in the running direction; each of the connecting links having a second radius defining the maximum distance from the axis of the trailing rivet opening of the next adjacent connecting link in the running direction to the rearward region of the connecting link, which rearward region faces toward the rearward running surface, and which rearward region lies opposite to the running direction; and, the second radius being greater than the first radius and the sum of the first and second radii corresponding approximately to the spacing (b).

The extension of the rearward running surface opposite to the running direction of the saw chain reduces the surface contact pressure on the rearward running surface and thereby prevents the formation of friction martensite. The wear volume increases because of the longer running surface and it therefore takes longer until a critical wall thickness occurs in the region of the trailing rivet opening. In this way, a long service life is achieved. The forward region and the rearward region in the chain longitudinal direction of neighboring connecting links are so matched to each other that an excellent chain movability is ensured and, at the same time, the service life of the saw chain is as long as possible. For this, the sum of first radius and second radius corresponds approximately to the spacing of the axes of the rivet openings of a drive link arranged between two connecting links. The forward running surface is shortened especially in correspondence to the lengthening of the rearward running surface.

The second radius is from over 50% to 70% of the spacing of the axes of the rivet openings of a drive link. A tearing out of the leading pivot opening of a drive link is prevented in that the forward region of a connecting link is configured to have the shape of a circular arc. The circle center point is especially the axis of the leading rivet opening. In this way, the largest possible wall thickness is realized in the region of the leading rivet opening. The second radius advantageously corresponds to from over 50% to up to 70% of the pitch of the saw chain. The first radius is 2.5 mm to 8.0 mm, the second radius is 4.0 mm to 13.0 mm and the pitch is 6.0 mm to 20.0 mm.

To prevent tilting of the cutting link because of cutting forces, it is provided that the connecting line from the roof knife and the axis of the trailing rivet opening intersect the rearward running surface. The distance of the intersect point to the axis of the trailing rivet opening is approximately from 70% to 90% of the second radius and is especially 85% to 90% of the second radius.

To reduce the surface contact pressure at the running surfaces, it is provided that at least one running surface of a connecting link extends from the intersect point of the perpendicular to the chain longitudinal direction through the axis of the rivet opening in the running direction and opposite to the running direction of the saw chain. Advantageously, the length of the rearward running surface from the rearward intersect point in the running direction amounts to from 70% to 110% of the length from the rearward intersect point opposite to the running direction. The rearward intersect point is the intersect point of the perpendicular to the chain longitudinal direction through the axis of the trailing rivet opening with the rearward running surface.

Advantageously, the length of the forward running surface from the forward intersect point in the running direction is less than the length from the forward intersect point opposite to the running direction and amounts to especially from 0% to 70%. In correspondence to the rearward intersect point, the forward intersect point is the intersect point of the perpendicular to the chain longitudinal direction through the axis of the leading rivet opening with the forward running surface. For the connecting links, which are configured as cutting links, it is provided that the forward running surface extends mostly in the running direction from the forward intersect point and the rearward running surface extends mostly opposite to the running direction from the rearward intersect point.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
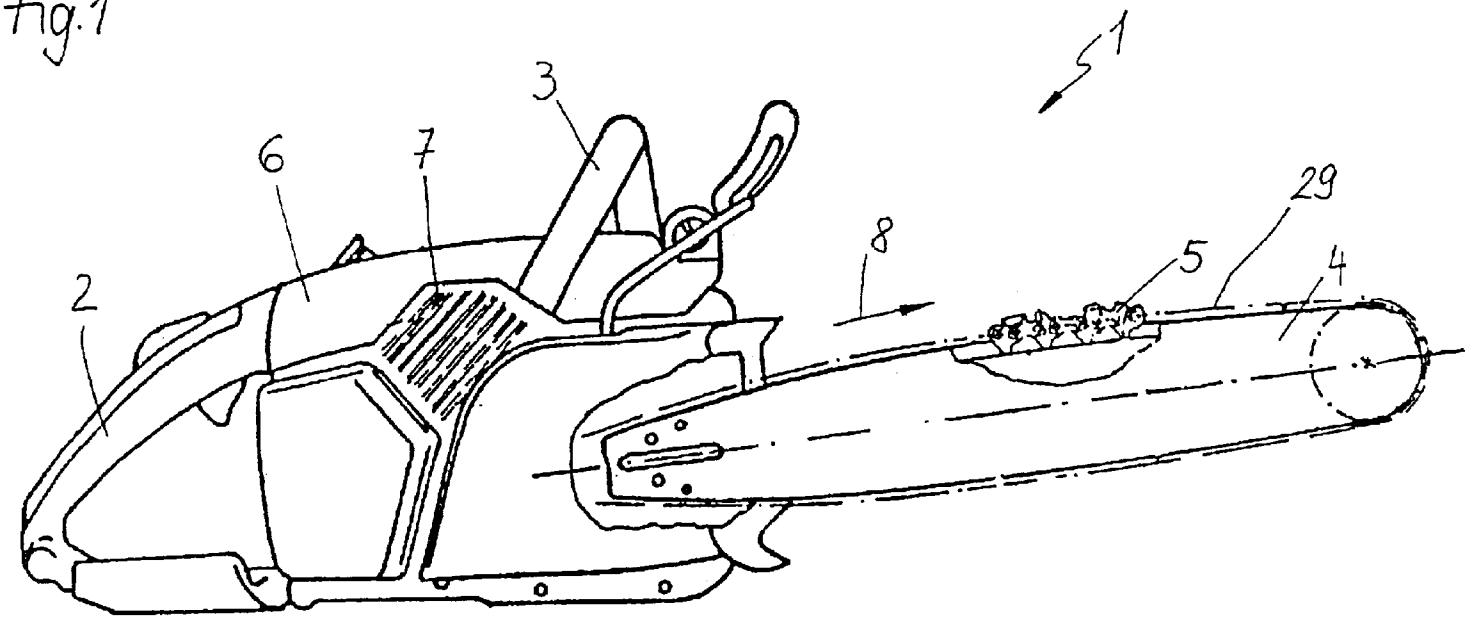
FIG. 1 is a side view of a motor-driven chain saw.

The motor-driven chain saw 1 shown schematically in FIG. 1 includes a housing 6 and an internal combustion engine 7 mounted therein. The engine 7 functions for driving a saw chain 5 guided in a guide bar 4. The saw chain 5 is moved in the running direction 8 parallel to the chain longitudinal direction 29. A handle 2 and a tubular handle 3 are arranged on the housing 6 for operating the motor-driven chain saw 1. The tubular handle 3 extends over the housing.

Figure 2:
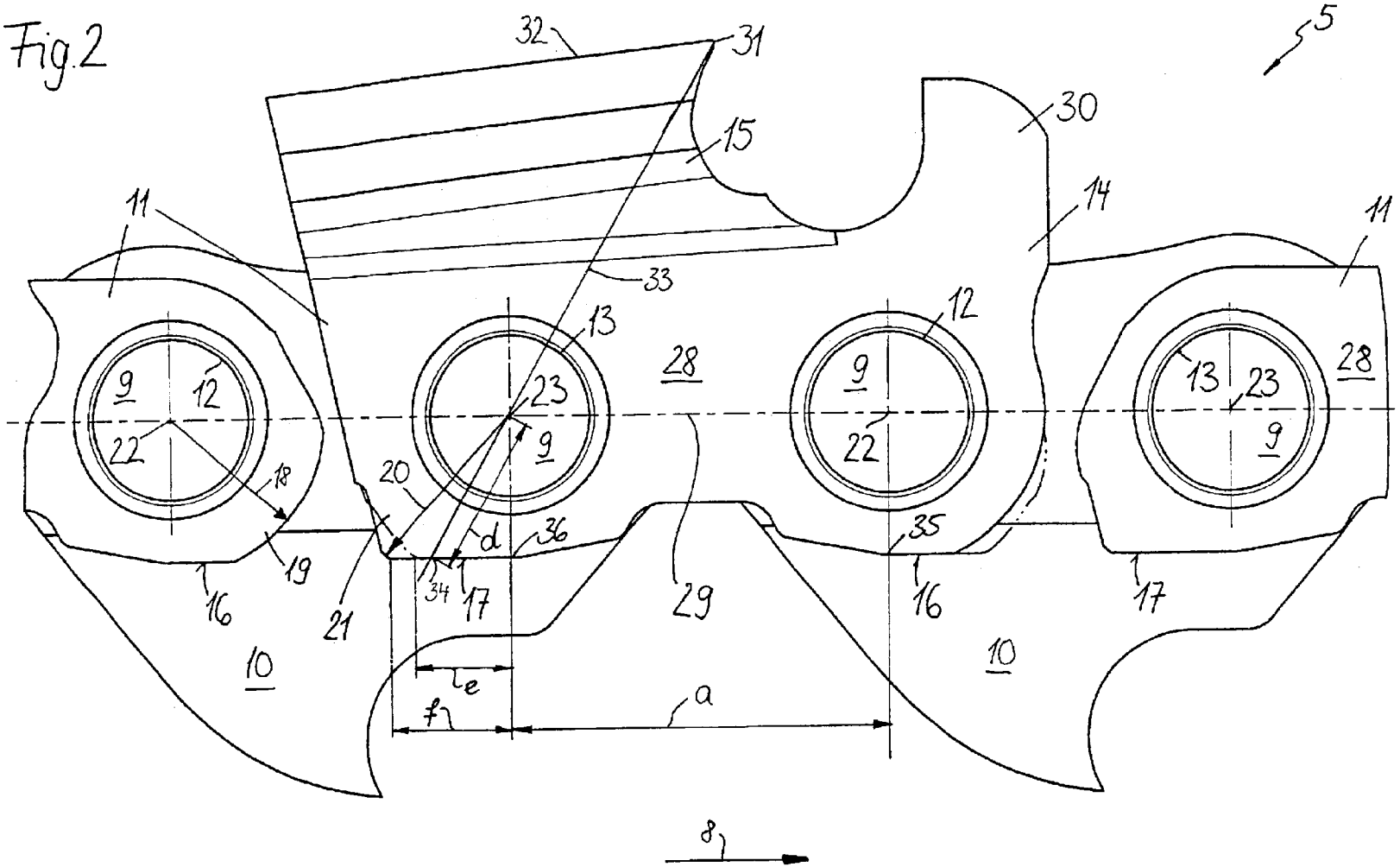
FIG. 2 is a side elevation view of a segment of the saw chain of the invention.
Figure 4:
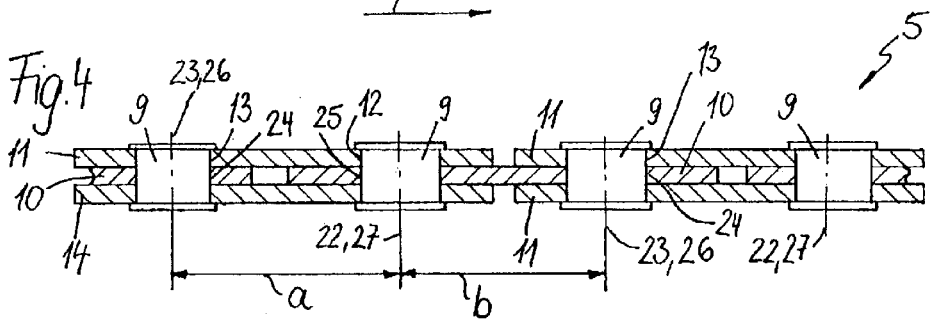
FIG. 4 is a section view taken along line IV—IV in FIG. 3.

A segment of the saw chain is shown enlarged in FIG. 2. The saw chain 5 includes connecting links 11 having leading rivet openings 12 and trailing rivet openings 13. Viewed in the longitudinal direction 29 of the saw chain, a drive link 10 is arranged between each two connecting links 11. As shown in section in FIG. 4, each drive link 10 has a leading rivet opening 24 and a trailing rivet opening 25. Each drive link 10 is arranged between two outside-lying connecting links 11. The saw chain links are connected to each other with rivet bolts 9. The rivet bolts connect leading rivet openings 24 of the drive links 10 to trailing rivet openings 13 of the connecting links 11 and connect leading rivet openings 12 of the connecting links 11 to trailing rivet openings 25 of the drive links 10.

A connecting link 11 is shown in FIG. 2 and is configured as a cutting link 14. The cutting link 14 includes a flat base body 28 on which a cutting tooth 15 is formed. The cutting tooth 15 includes a roof cutting edge 31 and a tooth roof 32 extending therefrom. A depth limiter 30 is formed on the base body 28 in the running direction 8 of the cutting edge 31. The cutting link 14 has running surfaces (16, 17) on the opposite lying side of the rivet openings (12, 13). Viewed in the longitudinal direction 29 of the saw chain, the forward running surface 16 is arranged approximately at the elevation of the leading rivet opening 12 and the rearward running surface 17 is approximately at the elevation of the trailing rivet opening 13. The axis 22 of the leading rivet opening 12 is at a spacing (a) from the axis 23 of the trailing rivet opening 13.

In the longitudinal direction 29 of the saw chain, connecting links 11 are disposed adjacent to the cutting link 14 and these connecting links 11 are purposefully not configured as coupling links. The first radius 18 of a connecting link 11 is the maximum distance of the axis 22 of the leading rivet opening 12 to the forward region 19 of the connecting link 11. The forward region 19 is especially the region, which lies in the running direction 8 and faces toward the forward running surface 16, between the longitudinal direction 29 of the saw chain and the perpendicular to the longitudinal direction 29. The forward region 19 is configured partially to have a circular arc. The circle center point is the axis 22 of the leading rivet opening 12.

The second radius 20 is the maximum distance of the rearward region 21 to the axis 23 of the trailing rivet opening 13. The region 21 is the region which lies in a direction opposite to the running direction 8 and faces toward the rearward running surface 17. This region 21 extends especially between the running direction 29 and the perpendicular to the running direction 29. The connecting line 33 of the cutting edge 31 and the axis 23 of the trailing rivet opening 13 intersects the rearward running surface 17 at the intersect point 34. The distance (d) of the intersect point 34 to the axis 23 of the trailing rivet opening 13 is less than the second radius 20. The distance (d) is advantageously from 70% to 95% of the second radius 20 and is especially 85% to 90% of this second radius 20.

The rearward running surface 17 is configured to be extended relative to a symmetrically configured connecting link 11. In FIG. 2, a symmetrically configured cutting link 14 is indicated by a dot-dash line. For a symmetrical configuration of the cutting link 14, the rearward running surface 17 has a length (e) from the intersect point 36 opposite to the running direction 8 which is less than the length (f) of the rearward running surface from the rearward intersect point 36 opposite to the running direction 8. The rearward running surface is configured to be extended as shown in FIG. 2. Advantageously, the length (f) is from 110% to 150% of the length (e) and is especially 130% to 145% of the length (e). The rearward intersect point 36 is the intersect point of the perpendicular to the running direction 29 through the axis 23 of the trailing rivet opening 13 with the rearward running surface 17. The rearward running surface 17 extends substantially from the rearward intersect point 36 opposite to the running direction 8, while the forward running surface 16 extends from the forward intersect point 35 mostly in the running direction 8. The forward intersect point 35 is the intersect point of the perpendicular to the longitudinal direction 29 of the saw chain through the axis 22 of the leading rivet opening 12.

Figure 3:
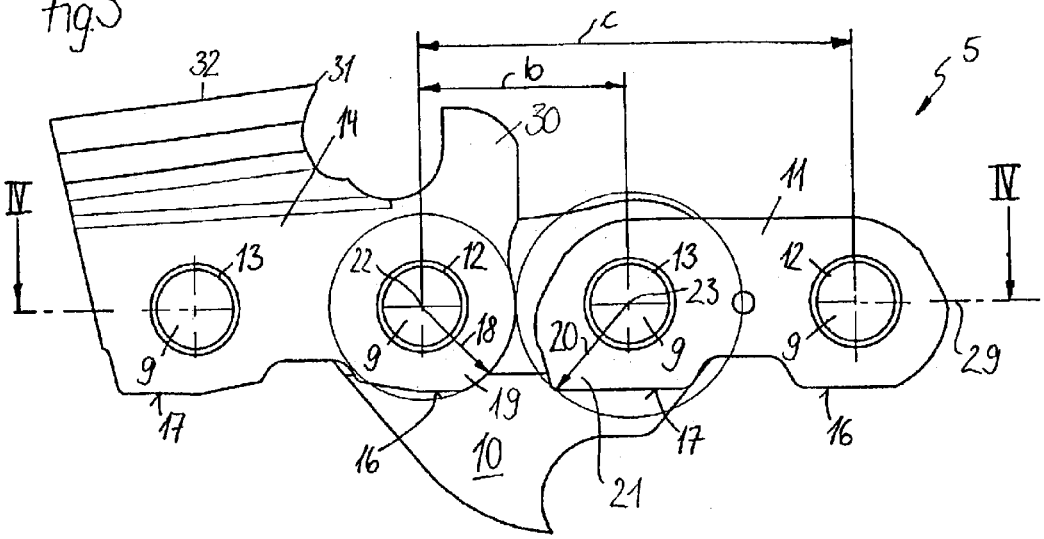
FIG. 3 is also a side view of a segment of the saw chain.

The cutting link 14, which is shown in FIG. 3, includes a first radius 18 which is less than the second radius 20 of the adjacently-mounted connecting link 11 in the running direction 8. The distance between the axis 22 of the leading rivet opening of the cutting link 14 and the axis 23 of the trailing rivet opening 13 of the connecting link 11 (arranged adjacently in the running direction 8) corresponds to the distance (b) (see FIG. 4) between the axis 26 of the leading rivet opening 24 of the drive link 10 and the axis 27 of the trailing rivet opening 25 of the drive link 10. The sum of first radius 18 and second radius 20 corresponds approximately to the distance (b) of the axes (26, 27) of the rivet openings (24, 25) of the drive link 10.

The leading rivet openings 12 of the cutting link 14 and of the cutting link 11 (adjacent in the running direction 8) have the distance (c) in the longitudinal direction 29 of the saw chain. This distance (c) corresponds to the sum of the distance (a) of the axes (22, 23) of the rivet openings (12, 13) of a connecting link 11 and the distance (b) of the axes (26, 27) of the rivet openings (24, 25) of a drive link 10. The pitch of the saw chain 5 corresponds to the pitch of the teeth of the forward idler wheel on the guide bar and is half of the distance (c). The second radius 20 is from over 50% to 70% of the distance (b) of the axes (26, 27) of the rivet openings (24, 25) of the drive link 10. It is provided that the second radius 20 corresponds to over 50% to 70% of the pitch. A first radius 18 especially is from 2.5 mm to 8.0 mm and the second radius 20 from 4.0 mm to 13.0 mm and the pitch from 0.6 mm to 20.0 mm.

Figure 5:
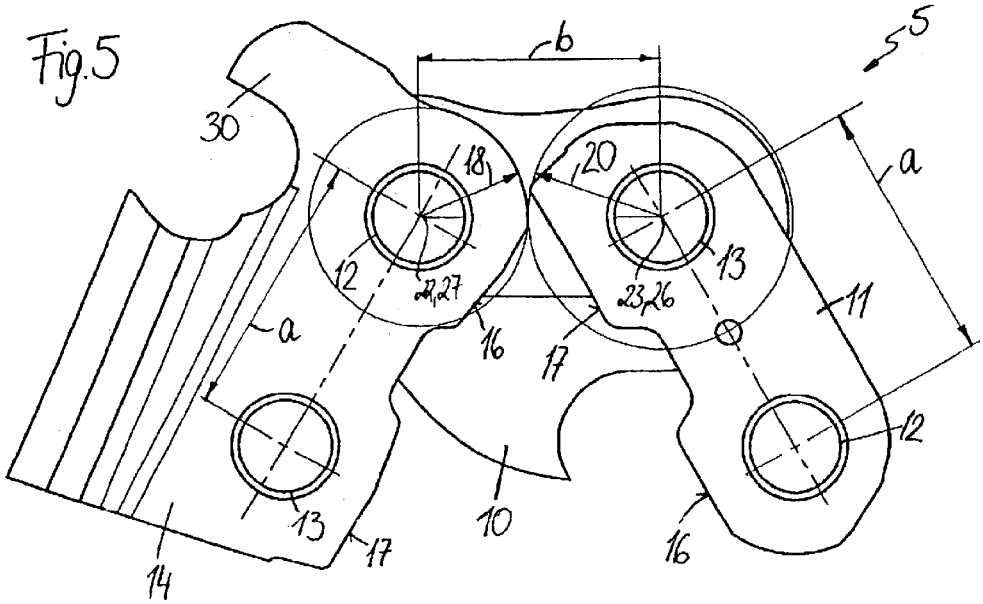
FIG. 5 shows the segment of FIG. 3 with the segments of the saw chain pivoted relative to each other.

In FIG. 5, a section view of the saw chain 5 is shown corresponding to the section of FIG. 3 but shown with the links pivoted at an angle relative to each other. The cutting link 14 and the connecting link 11 are freely movable relative to each other because the sum of the first radius 18 and the second radius 20 corresponds approximately to the distance (b) of the axes (26, 27) of the rivet openings (24, 25) of the drive link 10.

Figure 6:
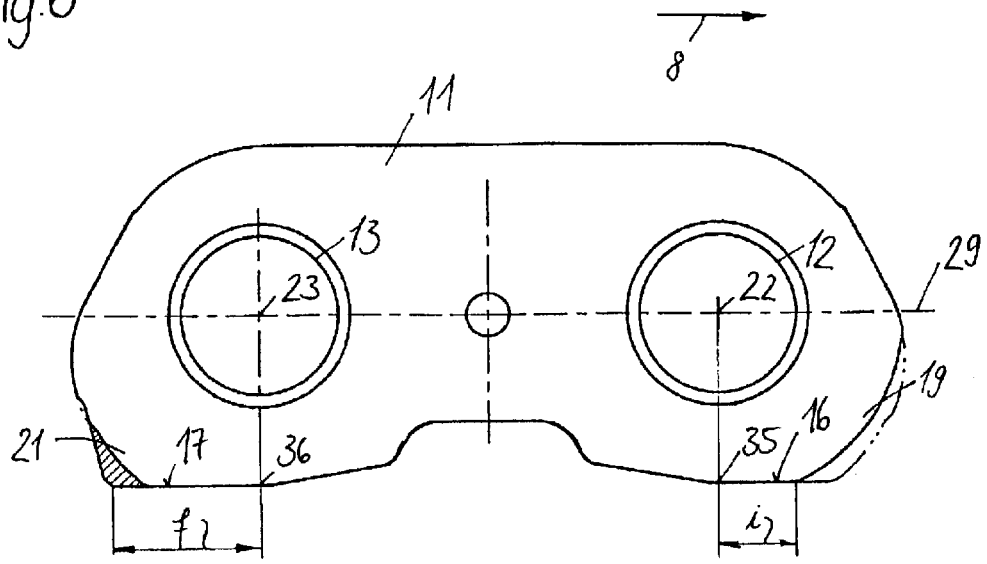
FIG. 6 shows a connecting link of a saw chain in side elevation.

A connecting link 11 is shown enlarged in FIG. 6. The rearward running surface 17 is configured enlarged opposite to the running direction 8 as indicated by the hatching in the rearward region 21 of the connecting link 11. The rearward running surface 17 extends from the intersect point 36 for the most part opposite to the running direction 8. The running surface 17 has the length (f) from the intersect point 36 in the direction opposite to the running direction 8. The forward running surface 16 extends for the most part in the running direction 8 from the intersect point 35. The forward running surface 16 has the length (i) from the intersect point 35 extending in the running direction 8. Advantageously, the length (i) is from 0% to 70% of the length (f). The forward running surface 16 and the rearward running surface 17 run approximately parallel to the longitudinal direction 29 of the saw chain.

Figure 7:
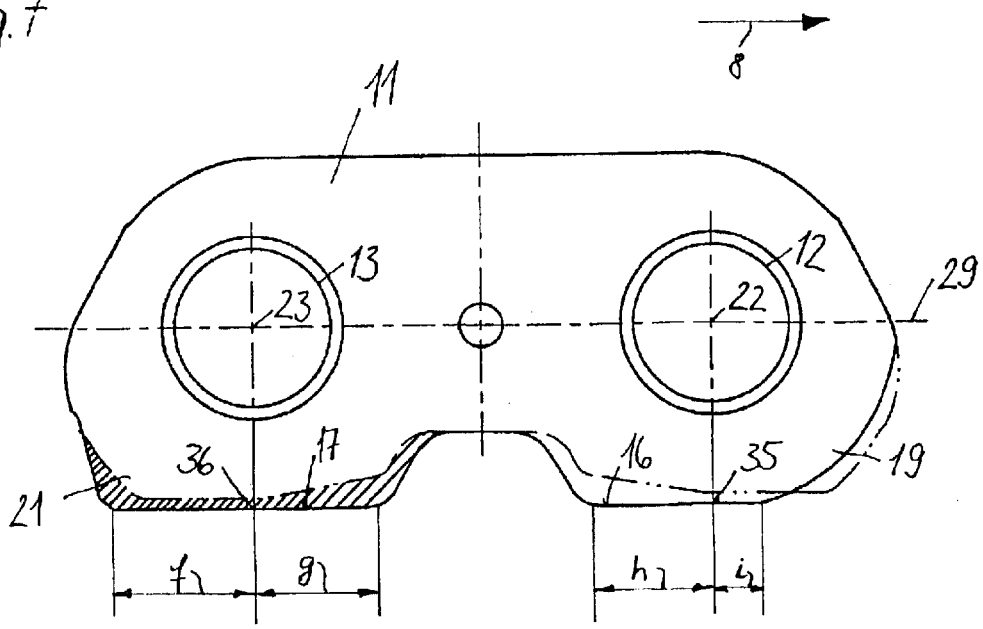
FIG. 7 is a side elevation view of another embodiment of a connecting link of the saw chain of the invention.

Another embodiment of the connecting link 11 is shown in FIG. 7. The rearward running surface 17 is configured to be extended compared to the forward running surface 16 opposite to the running direction 8 of the saw chain 5. The rearward running surface 17 extends from the intersect point 36 of the perpendicular to the longitudinal direction 29 of the saw chain 5 through the axis 23 of the trailing rivet opening 13 in the running direction 8 as well as opposite to the running direction 8. The length (g) of the running surface 17 from the intersect point 36 in the running direction 8 corresponds approximately to 70% to 110% of the length (f) of the running surface 17 from the intersect point 36 opposite to the running direction 8. As indicated by the hatching below the trailing rivet opening 13, the connecting link 11 is configured enlarged compared to a symmetrically configured connecting link. The forward running surface 16 has a length (h) from the intersect point 35 opposite to the running direction 8 which corresponds approximately to the length (g) of the rearward running surface 17. Viewed in the running direction 8, the length (i) of the forward running surface 16 from intersect point 35 is less than the length (h), advantageously from 0% to 70% of the length (h).

A saw chain 5 can be formed from the connecting links 11 shown in FIG. 6 or in FIG. 7. These connecting links are, in part, configured as cutting links 14. With reference to the saw chain shown in FIGS. 3 and 5, it can be advantageous to configure the cutting links 14 to correspond to the connecting links shown in FIG. 6 and to configure the connecting links 11 in correspondence to the connecting links 11 shown in FIG. 7. The connecting links 11 are arranged between two cutting links 14 in the longitudinal direction 29 of the saw chain. Advantageously, connecting links 11, which are arranged mutually adjacent perpendicularly to the longitudinal direction 29 of the saw chain, are configured to be the same with respect to their running surfaces.

It is understood that the foregoing description is that of the preferred embodiments of the invention and that various changes and modifications may be made thereto without departing from the spirit and scope of the invention as defined in the appended claims.

What is claimed is:

1. A saw chain for a motor-driven work apparatus including a chain saw and a harvester, the saw chain defining a longitudinal direction and a running direction and said saw chain comprising:

a plurality of side connecting links and a plurality of center drive links arranged between said side connecting links;

each of said links having a flat base body and a leading rivet opening and a trailing rivet opening and each rivet opening defining an axis;

the respective axes of the leading and trailing rivet openings of each drive link being at a spacing (b) from each other;

a plurality of rivets extending through said rivet openings for pivotally interconnecting said links;

a portion of said connecting links being configured as cutting links;

each of said cutting links having a cutting tooth formed on the base body thereof on a first end of the cutting link with said cutting tooth extending in said longitudinal direction of said saw chain;

each of said cutting links having forward and rearward running surfaces on a second end thereof lying opposite said first side;

said forward running surface being approximately at the elevation of said leading rivet opening and said rearward running surface being approximately at the elevation of said trailing rivet opening;

said rearward running surface being configured to be extended in a direction opposite to said running direction;

each of said connecting links having a first radius defining the maximum distance from the axis of the leading rivet opening thereof to the forward region of the connecting link which forward region faces toward the forward running surface and which forward region lies in said running direction;

each of said connecting links having a second radius defining the maximum distance from the axis of the trailing rivet opening of the next adjacent connecting link in said running direction to the rearward region of the connecting link which rearward region faces toward the rearward running surface and which rearward region lies opposite to said running direction; and, said second radius being greater than said first radius and the sum of said first and second radii corresponding approximately to said spacing (b).

2. The saw chain of claim 1, wherein said second radius is more than 50% to 70% of said spacing (b).

3. The saw chain of claim 1, wherein the forward running surface of said cutting links extends, for the most part, in said running direction from an intersect point on said forward running surface of a first perpendicular to said longitudinal direction of said chain saw through the axis of the leading rivet opening; and, wherein the rearward running surface of said at least one of said cutting links extends, for the most part, in a direction opposite to said running direction from an intersect point on said rearward running surface of a second perpendicular to said longitudinal direction of said saw chain through the axis of the trailing rivet opening.

4. The saw chain of claim 1,wherein said forward region of the connecting link is configured to include a circular arc edge defining a circular center.

5. The saw chain of claim 4, wherein said circular center is coincident with the axis of the leading rivet opening.

6. The saw chain of claim 1, wherein the saw chain has a predetermined pitch; said second radius corresponds to from over 50% to 70% of said pitch of said saw chain; and, said pitch is half of a spacing (c) between the axes of the leading rivet openings of each two connecting links mutually adjacent viewed in said longitudinal direction of said saw chain.

7. The saw chain of claim 6, wherein said first radius lies in a range from 2.5 mm to 8.0 mm; said second radius lies in a range from 40 mm to 13.0 mm; and, said pitch lies in a range from 6.0 mm to 20.0 mm.

8. The saw chain of claim 1, wherein said cutting tooth defines a cutting edge and has a tooth roof extending rearwardly from said cutting edge; and, an imaginary straight line connecting said cutting edge and the axis of the trailing rivet opening intersects said rearward running surface at an intersect point; and, a distance (d) from said intersect point to the axis of said trailing rivet opening is approximately from 70% to 95% of said second radius.

9. The saw chain of claim 8, wherein said distance (d) is from 85% to 90% of said second radius.

10. The saw chain of claim 1, wherein the forward running surface of at least one of said connecting links extends in a direction corresponding to said running direction from a first intersect point of a first perpendicular to said longitudinal direction through the axis of the leading rivet opening; and, the rearward running surface of the at least one connecting link extends in a direction opposite to said running direction from a second intersect point of a second perpendicular to said longitudinal direction through the axis of the trailing rivet opening.

11. The saw chain of claim 10, wherein said second intersect point is a rearward intersect point of said second perpendicular on said rearward running surface; and, said rearward running surface has a length (g) from said rearward intersect point in said running direction and a second length (f) from said second intersect point opposite to said running direction and said first length (g) is from 70% to 110% of said second length (f) of said rearward running surface.

12. The saw chain of claim 10, wherein said first intersect point is a forward intersect point of said first perpendicular on said forward running surface; said forward running surface has a first length (i) from said forward intersect point in said running direction and a second length (h) from said forward intersect point opposite to said running direction; and, said first length (i) is less than said second length (h).

13. The saw chain of claim 12, wherein said first length (i) is from 0% to 70% of said second length (h).

* * * * *

UNITED STATES PATENT AND TRADEMARK OFFICE

CERTIFICATE OF CORRECTION

PATENT NO. : 6,837,138 B2
DATED : January 4, 2005
INVENTOR(S) : Harald Mang

It is certified that error appears in the above-identified patent and that said Letters Patent is hereby corrected as shown below:

Column 7,
Line 21, delete “40 mm” and substitute -- 4.0 mm -- therefor.

Signed and Sealed this

Tenth Day of May, 2005

JON W. DUDAS
*Director of the United States Patent and Trademark Office*